US011510473B2

(12) United States Patent
Ohn

(10) Patent No.: US 11,510,473 B2
(45) Date of Patent: Nov. 29, 2022

(54) COSMETIC CONTAINER HAVING TOUCH MEMBER TO WHICH COSMETIC MATERIAL IS TRANSFERRED BY MEANS OF PRESSURIZED AIR

(71) Applicant: WORLD SPONGE MANUFACTURING CO., LTD., Incheon (KR)

(72) Inventor: Sungdae Ohn, Incheon (KR)

(73) Assignee: WORLD SPONGE MANUFACTURING CO., LTD., Incheon (KR)

( * ) Notice: Subject to any disclaimer, the term of this patent is extended or adjusted under 35 U.S.C. 154(b) by 0 days.

(21) Appl. No.: 17/265,624

(22) PCT Filed: Sep. 11, 2019

(86) PCT No.: PCT/KR2019/011798
§ 371 (c)(1),
(2) Date: Feb. 3, 2021

(87) PCT Pub. No.: WO2020/204278
PCT Pub. Date: Oct. 8, 2020

(65) Prior Publication Data

US 2022/0015523 A1 Jan. 20, 2022

(30) Foreign Application Priority Data

Apr. 5, 2019 (KR) ..... 10-2019-0040064

(51) Int. Cl.
*A45D 33/02* (2006.01)
*B05B 11/06* (2006.01)
(Continued)

(52) U.S. Cl.
CPC ..... *A45D 33/02* (2013.01); *A45D 33/34* (2013.01); *A45D 33/36* (2013.01); *B05B 11/061* (2013.01);
(Continued)

(58) Field of Classification Search
CPC ... B05B 11/062; B05B 11/061; B05B 11/046; A45D 33/36; A45D 33/02; A45D 33/34;
(Continued)

(56) References Cited

U.S. PATENT DOCUMENTS 6,142,695 A * 11/2000 Byun ..... A46B 17/04 401/187
6,234,181 B1 * 5/2001 Lou ..... A45D 33/00 401/102
(Continued)

FOREIGN PATENT DOCUMENTS

KR 200233951 9/2001
KR 200274588 5/2002
(Continued)

*Primary Examiner* — Patrick M. Buechner
(74) *Attorney, Agent, or Firm* — Lex IP Meister, PLLC

(57) ABSTRACT

A cosmetic container includes a body part having an empty hollow shape, and provided with a cosmetic material accommodation portion therein; a supply part disposed to pass through the material accommodation portion of the body part, provided in a hollow tube shape, and configured such that an air discharge through hole is formed on one side of a partition disposed inside a hollow tube and a material introduction through hole is formed on the other side of the partition; a pressure member coupled to communicate with the entrance of the supply part at one end of the body part, and configured to inject air into the supply part; and a touch member coupled to communicate with the exit of the supply part at the other end of the body part, and configured such
(Continued)

that a cosmetic material introduced through the material introduction through hole is transferred thereto.

17 Claims, 9 Drawing Sheets

(51) Int. Cl.
*A45D 33/36* (2006.01)
*A45D 33/34* (2006.01)

(52) U.S. Cl.
CPC ..... *B05B 11/062* (2013.01); *A45D 2200/054* (2013.01)

(58) Field of Classification Search
CPC ..... A45D 2200/054; A45D 34/042; A45D 2200/057; A45D 2200/10; A45D 2200/1009
See application file for complete search history.

(56) References Cited

U.S. PATENT DOCUMENTS 6,363,948 B2 * 4/2002 Choi ..... A45D 33/34 132/320
7,275,885 B2 * 10/2007 Byun ..... A46B 11/0055 401/278
2002/0040720 A1 * 4/2002 Byun ..... A45D 33/00 401/187

FOREIGN PATENT DOCUMENTS

KR 100823880 4/2008
KR 20120059893 6/2012
KR 20160060320 5/2016

* cited by examiner

COSMETIC CONTAINER HAVING TOUCH MEMBER TO WHICH COSMETIC MATERIAL IS TRANSFERRED BY MEANS OF PRESSURIZED AIR

TECHNICAL FIELD

The present invention relates to a cosmetic container to which a touch member is coupled. More specifically, the present invention relates to a cosmetic container having a touch member to which a cosmetic material is transferred by means of pressurized air.

BACKGROUND ART

There have been cosmetic containers including a structure in which a cosmetic material is transferred to a touch member such as a brush, a puff, or a sponge.

As an example of the prior art, there is Korean Patent No. 10-0841441 entitled 'Cosmetic Container with Dispersion Part.' This prior art is merely a combination of a cosmetic material and a touch part, which are separately provided, in the same container.

The cosmetic container is inconvenient in that a user needs to transfer the cosmetic material to the touch part by shaking the container. In addition, in the case of a powder cosmetic material such as a powder, it has the property of being lumped and tangled. When such a cosmetic material is lumped and tangled in this manner, a problem arises in that it is difficult to discharge the cosmetic material.

DISCLOSURE

Technical Problem

A cosmetic container having a touch member to which a cosmetic material is transferred by means of pressurized air according to the present invention has the following technical problems:

First, the cosmetic container is intended to inject pressurized air by pumping a pressure member and to transfer a cosmetic material to a touch member by using pressurized air.

Second, the cosmetic container is intended to crush an agglomerate cosmetic material to a predetermined degree by means of a flow of pressurized air.

Third, the cosmetic container is intended to prevent a backflow phenomenon because a cosmetic material may also flow back when air flows back through a repeated pumping operation.

Fourth, the cosmetic container is intended to spray a cosmetic material evenly onto a touch member.

The technical problems of the present invention are not limited to those described above, and other technical problems not described above will be clearly understood by those of ordinary skill in the art from the following description.

Technical Solution

A first embodiment of a cosmetic container having a touch member to which a cosmetic material is transferred by means of pressurized air according to the present invention includes: a body part having an empty hollow shape, and provided with a cosmetic material accommodation portion therein; a supply part disposed to pass through the material accommodation portion of the body part, provided in a hollow tube shape, and configured such that an air discharge through hole is formed on one side of a partition disposed inside a hollow tube and a material introduction through hole is formed on the other side of the partition; a pressure member coupled to communicate with the entrance of the supply part at one end of the body part, and configured to inject air into the supply part; and a touch member coupled to communicate with the exit of the supply part at the other end of the body part, and configured such that a cosmetic material introduced through the material introduction through hole is transferred thereto.

A second embodiment of a cosmetic container having a touch member to which a cosmetic material is transferred by means of pressurized air according to the present invention includes: a body part having an empty hollow shape, and provided with a cosmetic material accommodation portion therein; a supply part disposed to pass through the material accommodation portion of the body part, provided in a hollow tube shape, and configured such that a plurality of material introduction through holes are formed in a hollow tube; a pressure member coupled to communicate with the entrance of the supply part at one end of the body part, and configured to inject air into the supply part; and a touch member coupled to communicate with the exit of the supply part at the other end of the body part, and configured such that a cosmetic material introduced through the material introduction through hole is transferred thereto.

In the present invention, a first discharge guide portion protruding outward may be provided above the air discharge through hole.

In the present invention, a second discharge guide portion protruding inward may be provided on the inner surface of the material accommodation portion opposite to the air discharge through hole.

In the present invention, a backflow prevention member may be disposed inside the supply part.

In the present invention, the backflow prevention member may be at least any one of a filter member and a brush member.

In the present invention, the backflow prevention member may be disposed in a spiral shape.

In the present invention, a spray nozzle may be coupled to the exit of the supply unit, and the spray nozzle may be seated on an inner seating portion provided on the touch member.

In the present invention, the spray nozzle may be provided with a plurality of nozzle discharge portions disposed in the longitudinal or diagonal direction of the supply part.

In the present invention, the pressure member may be provided as a bellows structure capable of extending and contracting.

In the present invention, a cover may be provided on the outside of the pressure member.

In the present invention, the cosmetic container may further include an elastic spring disposed beside the bellows structure so as to guide the bellows structure through the extension and contraction thereof.

In the present invention, a backflow prevention check valve may be provided in the discharge hole of the pressure member, and an air hole through which air is introduced may be provided on one side of the pressure member.

Advantageous Effects

The cosmetic container having a touch member to which a cosmetic material is transferred by means of pressurized air according to the present invention has the following effects:

First, the cosmetic container has the effect of effectively transferring a cosmetic material to the touch member by using pressurized air generated by pumping the pressure member such as a bellows structure.

Second, the cosmetic container has the effect to allow an agglomerate cosmetic material to collide and be partially crushed by means of the flow of pressurized air while the pressurized air exiting from the air discharge through hole of the supply part flows into the cosmetic material introduction hole.

Third, the cosmetic container has the effect of blocking a cosmetic material from flowing back together with backflow air so that it does not flow back by disposing the backflow prevention member inside the supply part.

Fourth, the cosmetic container has the effect of evenly spraying a cosmetic material by adjusting the spray angles and diameter of the nozzle discharge portions of the spray nozzle.

The effects of the present invention are not limited to those described above, and other effects not described above will be clearly understood by those of ordinary skill in the art from the following description.

BEST MODE

Figure 1:
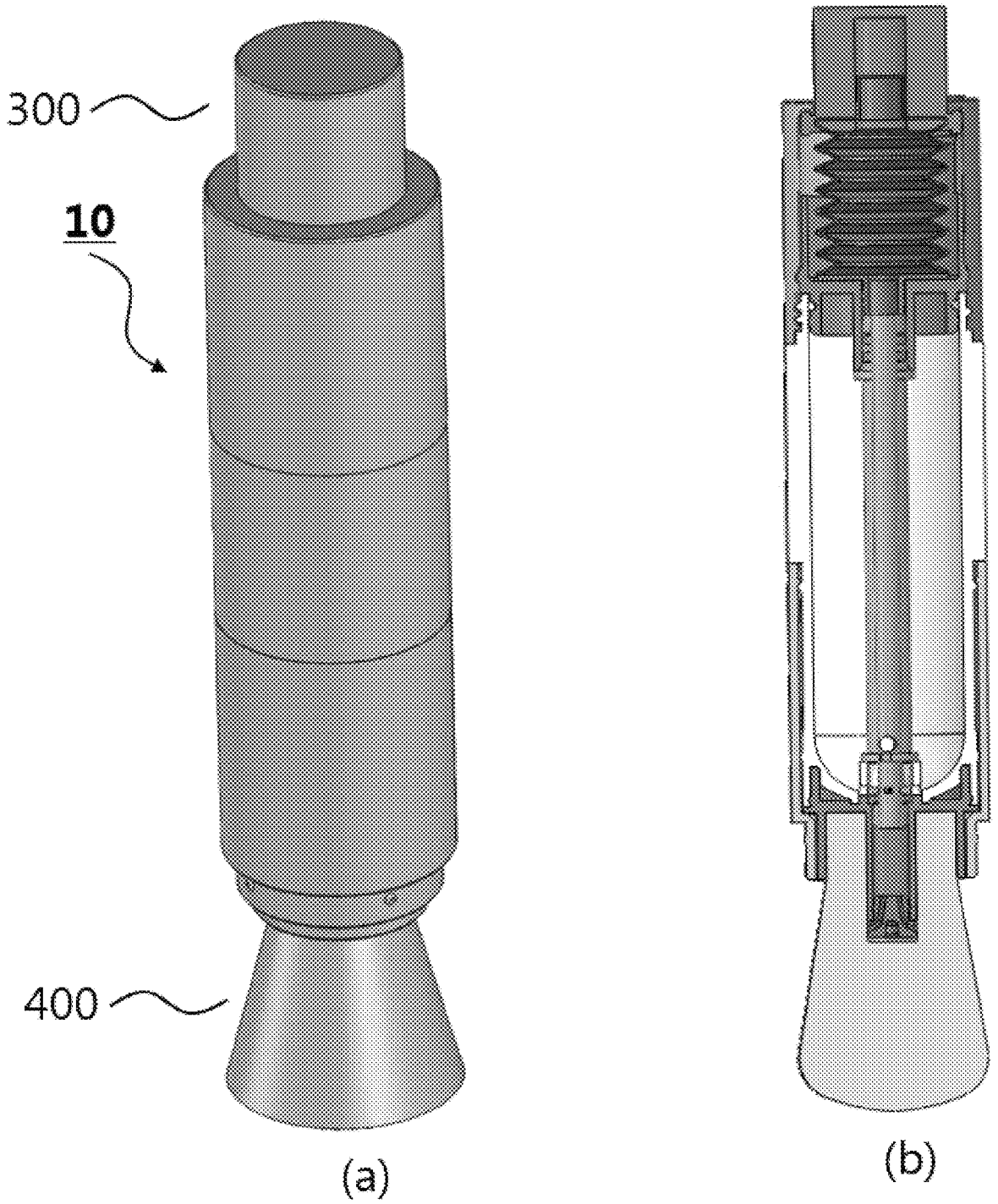
FIG. 1*a* is a perspective view of a cosmetic container according to the present invention.
FIG. 1*b* is a longitudinal sectional view of FIG. 1*a;*

A first embodiment of a cosmetic container having a touch member to which a cosmetic material is transferred by means of pressurized air according to the present invention includes: a body part having an empty hollow shape, and provided with a cosmetic material accommodation portion therein; a supply part disposed to pass through the material accommodation portion of the body part, provided in a hollow tube shape, and configured such that an air discharge through hole is formed on one side of a partition disposed inside a hollow tube and a material introduction through hole is formed on the other side of the partition; a pressure member coupled to communicate with the entrance of the supply part at one end of the body part, and configured to inject air into the supply part; and a touch member coupled to communicate with the exit of the supply part at the other end of the body part, and configured such that a cosmetic material introduced through the material introduction through hole is transferred thereto.

MODE FOR INVENTION

Embodiments of the present invention will be described with reference to the accompanying drawings so that those of ordinary skill in the art to which the present invention pertains can easily practice the present invention. As can be easily understood by those of ordinary skill in the art to which the present invention pertains, the embodiments to be described later may be modified in various forms without departing from the concept and scope of the present invention. The same or similar portions are denoted by the same reference numerals throughout the drawings as much as possible.

The technical terms used herein are intended merely to refer to specific embodiments, but are not intended to limit the invention. In this case, the singular forms used herein also include plural forms unless the phrases clearly indicate the opposite.

The meaning of the term "including" specifies a specific feature, region, integer, step, operation, element, and/or component, but does not exclude the presence or addition of another specific feature, region, integer, step, operation, element, component and/or a group thereof.

All the terms including technical or scientific terms used herein have the same meanings as commonly understood by those of ordinary skill in the art to which the present invention pertains. The terms defined in the dictionaries are further interpreted as having meanings consistent with the related technical documents and the presently disclosed content, and are not interpreted as having ideal or excessively formal meanings unless defined as such.

A cosmetic material according to the present invention includes a cosmetic material in the form of a powder and a cosmetic material in the form of a liquid that are flowable materials. However, in order to easily describe the invention, a cosmetic material in the form of a powder will be described as an example in the drawings, etc.

The present invention may be divided into a first embodiment having a partition inside a supply pipe into which pressurized air is injected, and a second embodiment having no partition.

The first embodiment of the present invention will be described below with reference to the drawings.

The structure and operation of the present invention will be described based on the upward, downward, leftward and rightward directions shown in the drawings. However, the structure and the operation are not limited to the directions shown in the drawings.

Figure 2:
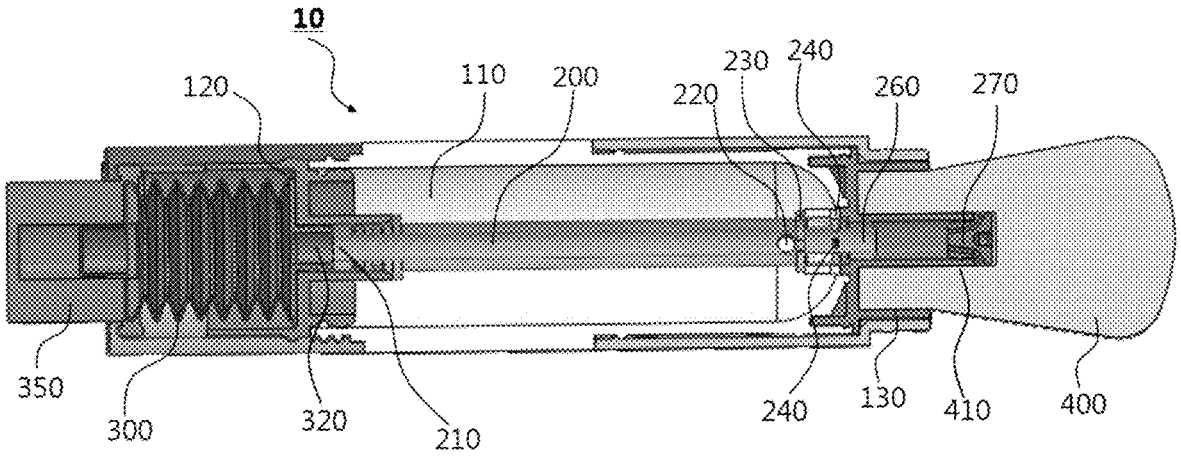
FIG. 2 is a view of the analysis of FIG. 1*b;*
Figure 3:
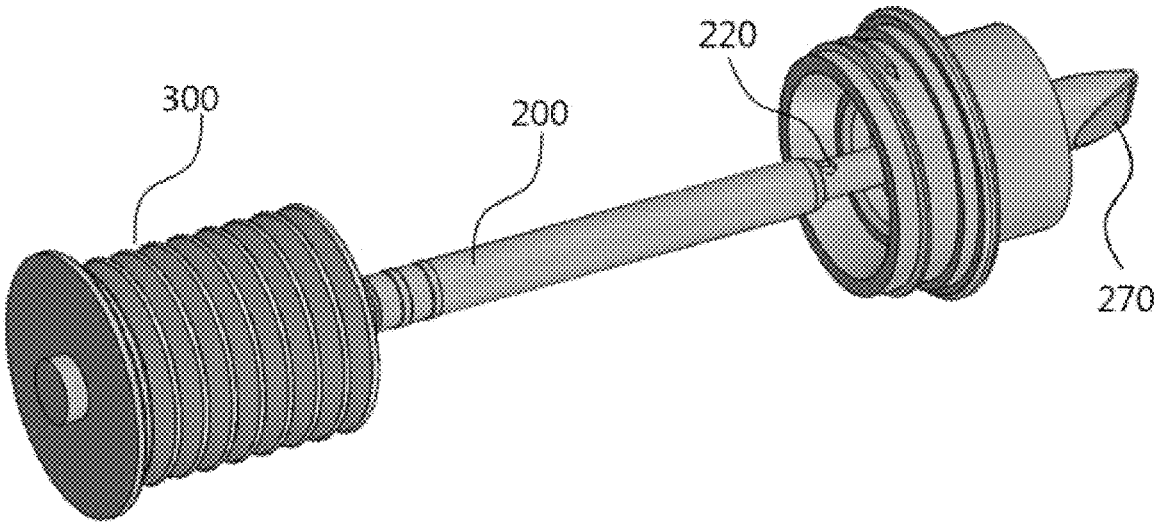
FIG. 3 shows a supply part and a pressure member according to the present invention.
Figure 4:
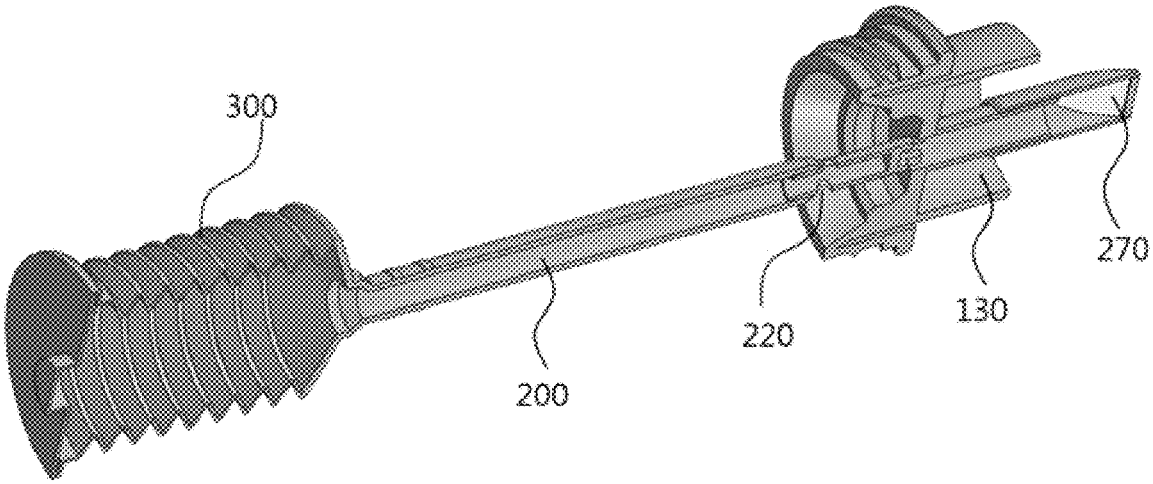
FIG. 4 is a longitudinal sectional view of FIG. 3.
Figure 5:
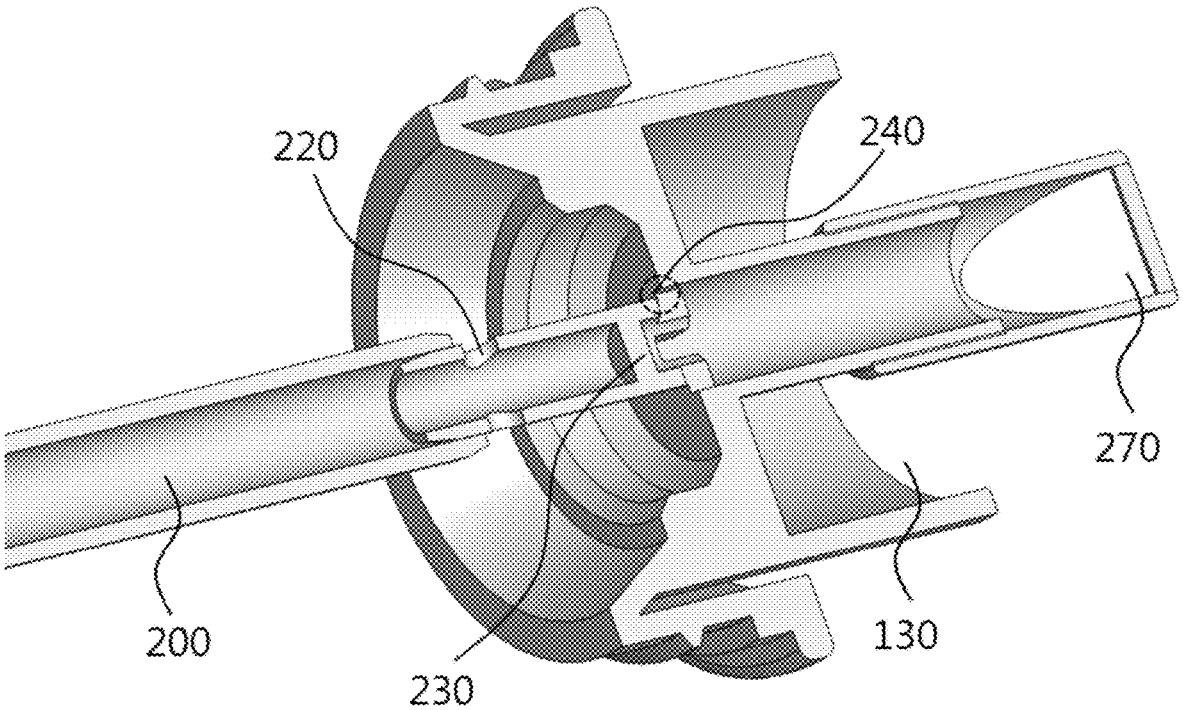
FIG. 5 is a partially enlarged view showing the air discharge through hole, partition, and material introduction through hole of the supply part in FIG. 4.

FIG. 1*a* is a perspective view of a cosmetic container according to the present invention, and FIG. 1*b* is a longitudinal sectional view of FIG. 1*a*. FIG. 2 is a view of the analysis of FIG. 1*b*.

The cosmetic container according to the present invention is a cosmetic container having a touch member to which a cosmetic material is transferred by means of pressurized air, and includes a body part 100, a supply part 200, a pressure member 300, and a touch member 400.

The body part 100 according to the present invention has an empty hollow shape, and a cosmetic material accommodation portion 110 may be provided in the body part 100.

The supply part 200 according to the present invention is disposed to pass through the material accommodation portion 110 of the body part 100, and is provided in the shape of a hollow tube. An air discharge through hole 220 may be formed on one side of a partition 230 disposed inside the hollow tube, and a material introduction through hole 240 may be formed on the other side of the partition 230.

The pressure member 300 according to the present invention is coupled to communicate with the entrance 210 of the supply part 200 at one end of the body part 100, and may inject pressurized air into the supply part 200.

The touch member 400 according to the present invention is coupled to communicate with the exit 260 of the supply part 200 at the other end of the body part 100. The cosmetic material introduced through the material introduction through hole 240 may be transferred together with pressurized air.

Figure 6:
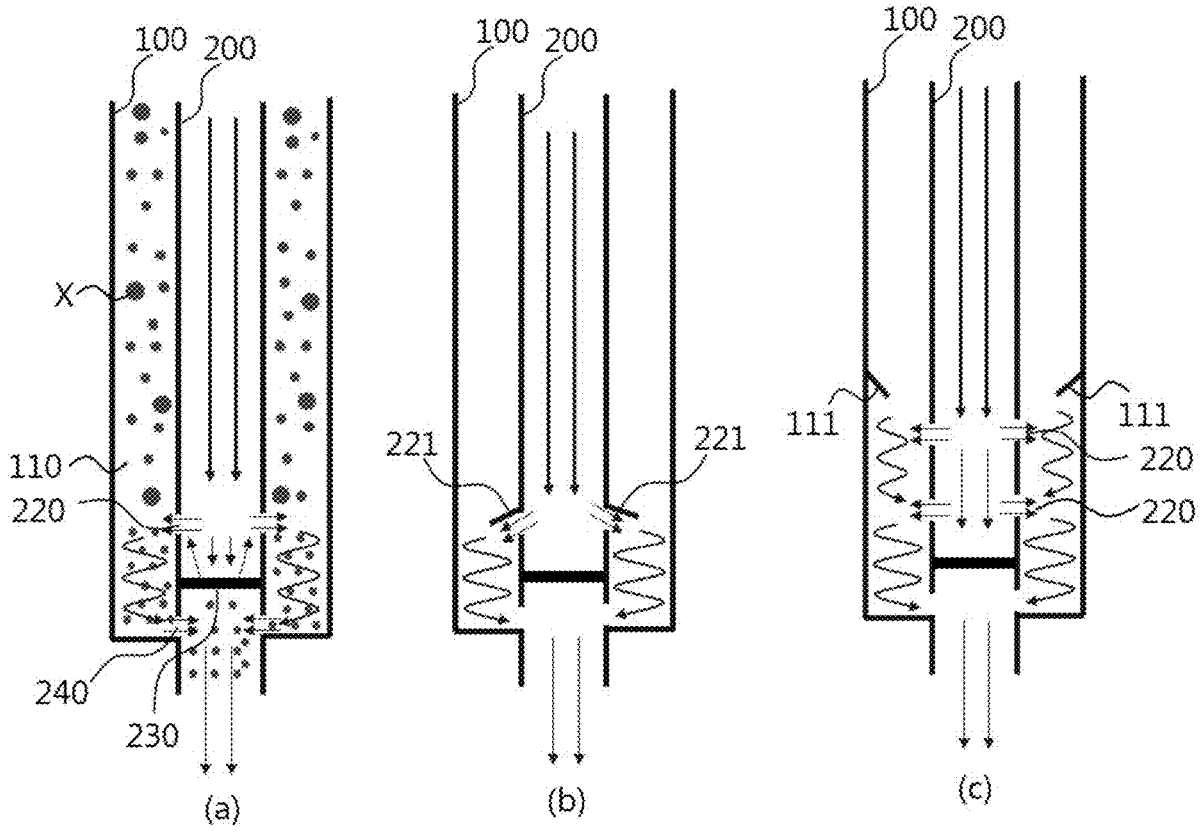
FIG. 6*a* shows a state in which pressurized air and a cosmetic material are moved by the configuration of FIGS. 3 to 5.
FIG. 6*b* shows an embodiment in which a first discharge guide portion is additionally provided.
FIG. 6*c* shows an embodiment in which a second discharge guide portion is additionally provided.

FIG. 6*a* shows a state in which pressurized air and a cosmetic material are moved by the configuration of FIGS. 3 to 5, FIG. 6*b* shows an embodiment in which a first discharge guide portion is additionally provided, and FIG. 6*c* shows an embodiment in which a second discharge guide portion is additionally provided.

As shown in FIG. 6*a*, the air pressurized by the pressure member 300 is moved from the top of the supply pipe 200 to the bottom thereof. The moved air is discharged through the air discharge through hole 220. The air having passed through the air discharge through hole 220 also collides with the partition 230, cannot move forward, and is discharged through the air discharge through hole 220.

The air discharged through the air discharge through hole 220 is discharged at a high pressure to the material accommodation portion 110 in which a powder cosmetic material X and the like are accommodated. The discharged air flows back into the supply pipe 200 through the cosmetic material introduction through hole 240. In this case, the introduced air contains a large amount of powder cosmetic material X, and is moved to a spray nozzle 270.

Meanwhile, while the air discharged from the air discharge through hole 220 flows back into the material introduction through hole 240, the air is strongly mixed and rotated. By the flow of air, the powder that is lumped or entangled in the material accommodation portion 110 may be crushed or disrupted through collision with each other.

The present invention is characterized in that the material that is sprayed onto the touch member 400 is changed into a fine powder state by using the mutual collision of the powder.

In order to activate the mutual collision of the powder material X through the flow of air, the present invention may further include a discharge guide portion.

As shown in FIG. 6*b*, a first discharge guide portion 221 protruding outward is provided above the air discharge through hole 220, and thus guides the discharged air to move downward rather than upward.

Furthermore, as shown in FIG. 6*c*, a second discharge guide portion 111 protruding inward is provided on the inner surface of the material accommodation portion 110 opposite to the air discharge through hole 220, and thus guides the discharged air to move downward rather than downward.

The air discharged by a strong pressure is allowed to maintain a strong flow in the section between the air discharge through hole 220 and the material introduction through hole 240, thereby inducing the mutual collision of the powder material X in the corresponding section as much as possible.

Meanwhile, as shown in FIG. 6*c*, a plurality of air discharge through holes 220 may be provided, and a plurality of material introduction through holes 240 may be provided. The appropriate number, diameter, and spacing of through holes may be selected by taking into considering the pressure of pressurized air and the amount of material injected in a comprehensive manner.

FIGS. 7*a* to 7*d* show a state in which a backflow prevention member according to the present invention is disposed inside a supply pipe.

When air is pressurized by pumping a pressure member, the air may be repeatedly moved downward and upward according to the pumping operation. The downward movement of air, i.e., movement in a forward direction, is a flow that is to be utilized in the present invention. However, the upward flow of air, i.e., a flow in the reverse direction, is a flow required to be prevented in the present invention.

The air having passed through an air discharge through hole 220 contains a powder material. The air containing the powder material flows back into the air discharge through hole 220, and further flows back through a supply pipe 200, thereby reaching a pressure member 300.

Figure 9:
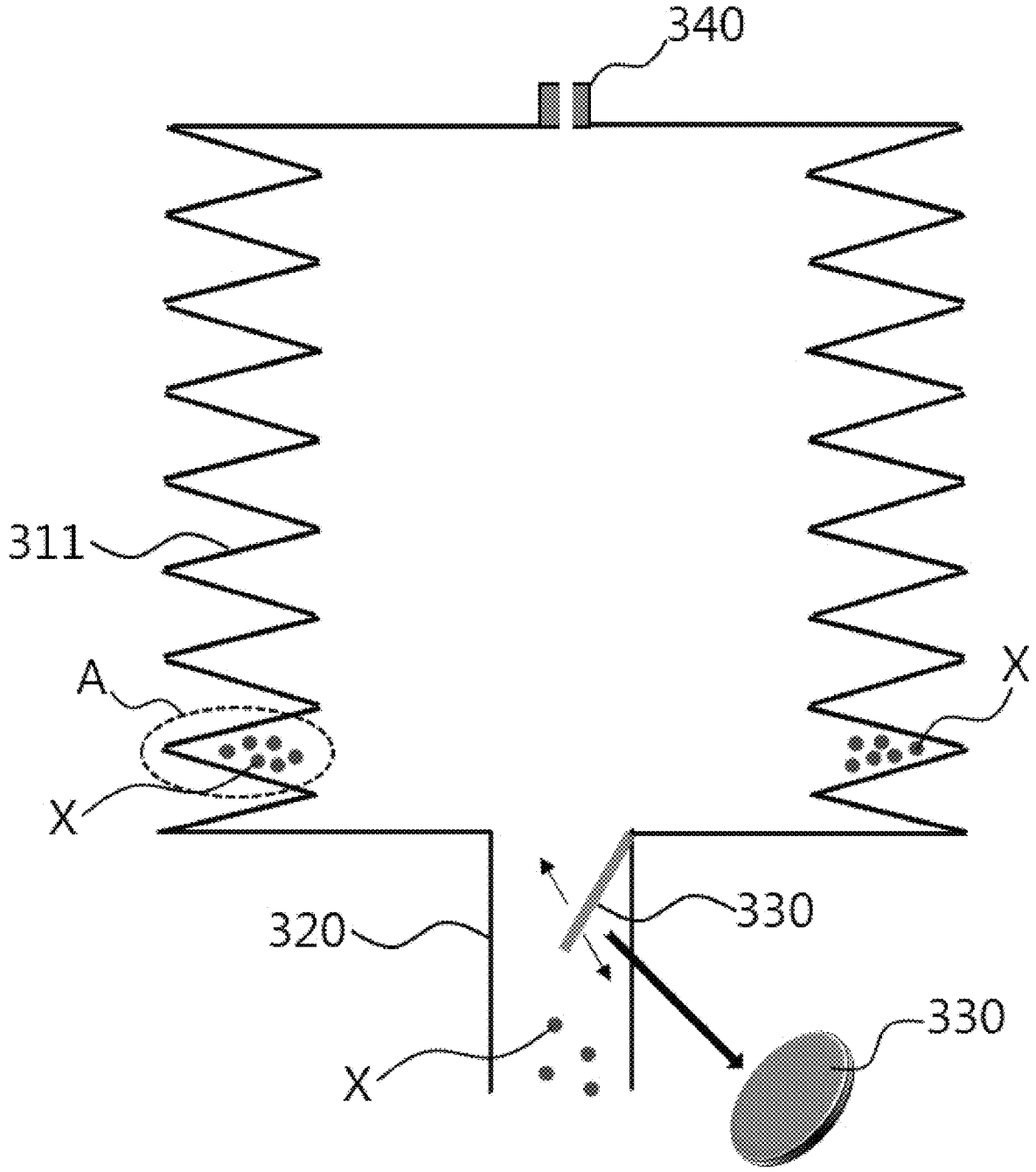
FIG. 9 shows an embodiment of a pressure member according to the present invention, in which a backflow prevention check valve and an air hole are provided.

As shown in FIG. 9, a cosmetic material X may be accumulated in spaces A between the bellows portions of a pressure member composed of a bellows structure 311.

When such backflow occurs, it may interfere with the operation of the pressure member and the like and cause poor pumping. Furthermore, a problem arises in that the material to be used by a user is accumulated inside the container.

Therefore, the prevention of the backflow of air is a significantly important factor in the present invention.

Accordingly, it is preferable that a backflow prevention member 250 be disposed inside the supply part 200 according to the present invention.

The backflow prevention member 250 according to the present invention may be at least one of a filter member 251 and a brush member 252.

Figure 7:
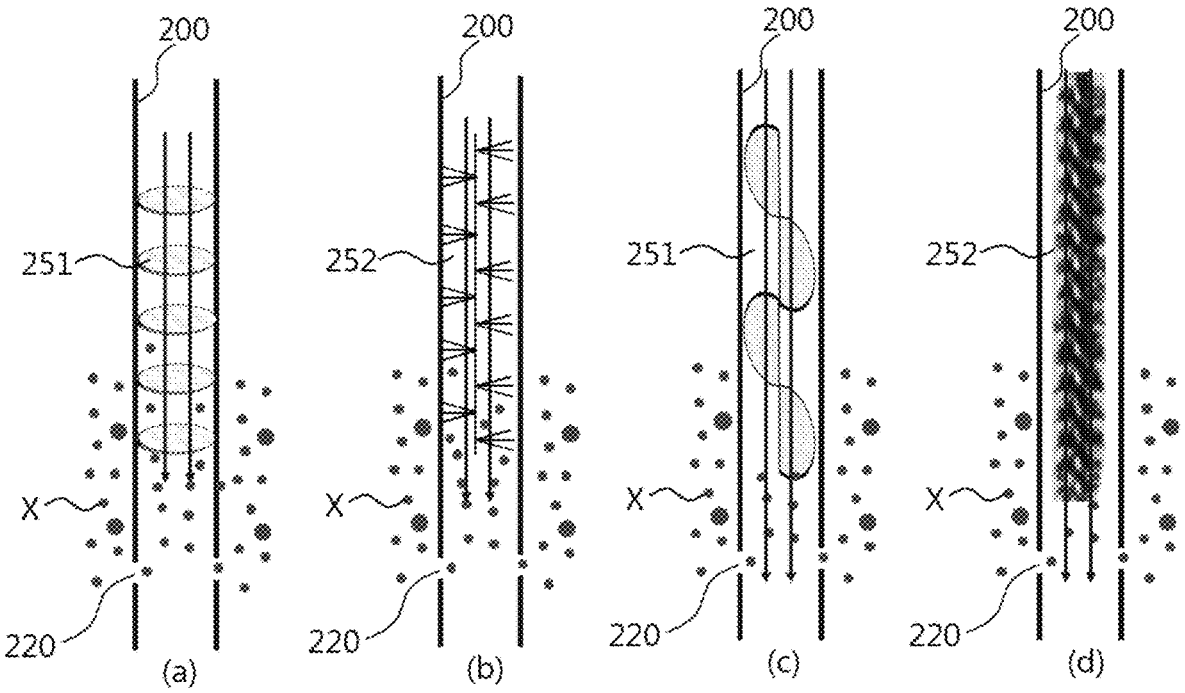
FIGS. 7*a* to 7*d* show examples in which a backflow prevention member according to the present invention is disposed inside a supply pipe.

FIG. 7*a* shows an embodiment in which a plurality of filter members 251 in the form of a thin filter membrane are disposed in the supply pipe 200 as the backflow prevention member 250.

FIG. 7*b* shows an embodiment in which a plurality of filter members 252 in the form of a brush are spaced apart from each other in the supply pipe 200 as the backflow prevention member 250.

Meanwhile, although it is important for the backflow prevention member 250 to prevent the backflow of the cosmetic material, it will be considerably important in terms of the original function to inject pressurized air in the forward direction.

In the present invention, the backflow prevention member 250 may be provided in a spiral shape so that it does not interfere with the forward movement of the pressurized air.

The spirally shaped backflow prevention member serves to smooth the movement of the pressurized air while guiding the flow of the pressurized air inside the supply pipe 200 in a spiral form. It is obvious that the backflow of the cosmetic material contained in the air may be smoothly filtered out.

FIG. 7*c* shows an embodiment in which a filter member 251 in the form of a thin filter membrane is disposed in a spiral shape inside the supply pipe 200 as the backflow prevention member 250.

FIG. 7*d* shows an embodiment in which a filter member 252 in the form of a brush is disposed in a spiral shape inside the supply pipe 200 as the backflow prevention member 250.

Meanwhile, in the present invention, in order to prevent the backflow of air, the pressure member 300 is additionally provided with the following configuration. FIG. 9 shows an embodiment of a pressure member according to the present invention, in which a backflow prevention check valve and an air hole are provided.

A backflow prevention check valve 330 may be provided in the discharge hole 320 of a pressure member 300. Furthermore, an air hole 340 through which air is introduced may be provided on one side of the pressure member 300.

As shown in FIG. 9, when the pressure member 300 of a bellows structure 310 is pumped downward and pressurized air is injected into the supply pipe 200 in the forward direction, the backflow prevention check valve 330 is moved downward and open the discharge hole 320. When pressurized air flows back in the reverse direction, the backflow prevention check valve 330 is moved upward and closes the discharge hole 320.

When the discharge hole 320 is closed, air to be pumped into the bellows structure 310 next time is separately required.

The air hole 340 according to the present invention serves as a passage that supplies new air into the bellows structure 310 in this situation. It will be apparent that since air should not leak into the air hole 340 when the bellows structure 310 is pumped while moving downward, the air hole 340 is preferably provided in an air check valve structure configured to control the flow of air in one direction.

Figure 8:
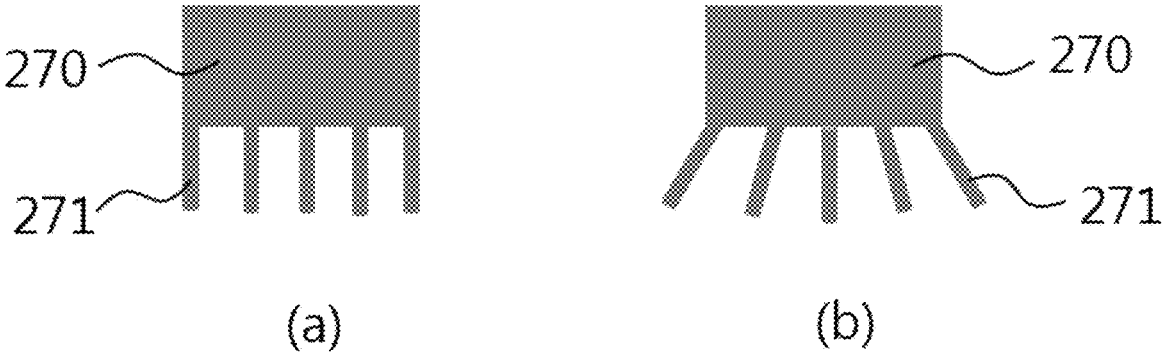
FIGS. 8*a* and 8*b* show embodiments of a spray nozzle and nozzle discharge portions according to the present invention.

FIGS. 8*a* and 8*b* show embodiments of a spray nozzle and a nozzle discharge portion according to the present invention.

In the present invention, the spray nozzle 270 is coupled to the exit 260 of the supply part 200, and the spray nozzle 270 may be seated on an inner seating portion 410 provided in the touch member 400. Furthermore, it is preferable to form a touch member seating portion 130 that is a space configured to stably seat the touch member 400 on the body part 200.

In the spray nozzle 270 according to the present invention, a plurality of nozzle discharge portions 271 disposed in the longitudinal or diagonal direction of the supply part may be formed to be spaced apart from each other.

It is preferable that the number, arrangement angles, length, and diameter of nozzle discharge portions 271 be determined based on the relationship with the touch member 400 to be coupled with the nozzle discharge portions 271.

Furthermore, when pressurized air is strongly sprayed in a straight line, a risk arises in that the cosmetic material will be transferred to a user's eyes. Accordingly, it is preferable that the angles at which the nozzle discharge portions 271 are arranged be appropriately arranged in a straight direction, which is the longitudinal or diagonal direction of the supply part, by taking into consideration discharge conditions such as discharge pressure.

The touch member 400 according to the present invention may be provided in various forms such as a brush, a puff, and a sponge, and the form of the touch member 400 may be selected according to the characteristics of a cosmetic material, a makeup method, and/or the like.

The pressure member 300 according to the present invention may be provided as a bellows structure 310 capable of extending and contracting. A structure that facilitates a pumping operation is the bellows structure. A member that pressurizes air by various methods, such as a method using the elasticity of an elastic material, may be employed.

Figure 10:
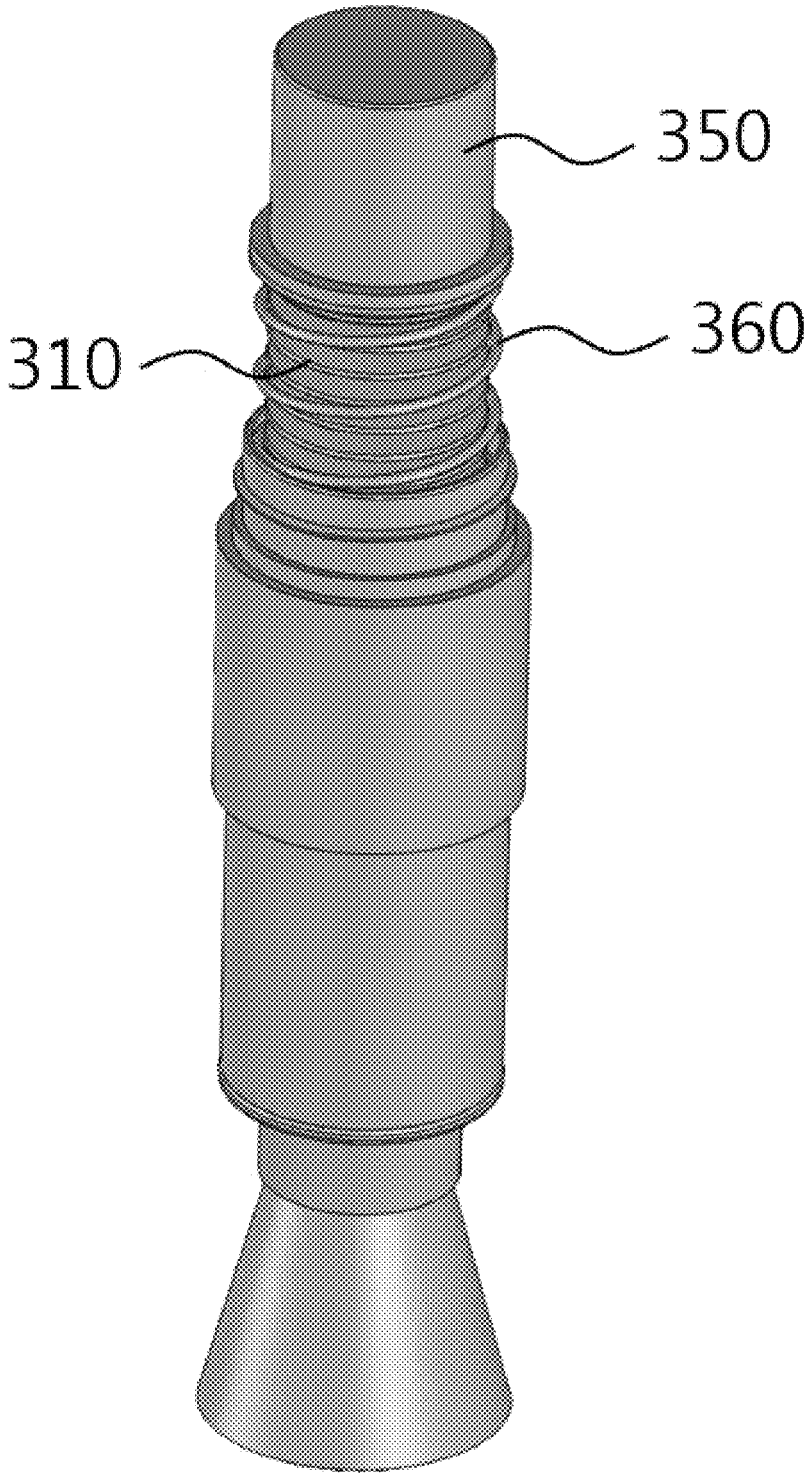
FIG. 10 shows an embodiment regarding a pressure member according to the present invention, in which a cover and an elastic spring are provided.

FIG. 10 shows an embodiment regarding a pressure member according to the present invention, in which a cover and an elastic spring are provided.

A cover 350 may be provided on the outside of the pressure member 300 according to the present invention.

Furthermore, it is preferable to further include an elastic spring 360 disposed beside a bellows structure 310 so as to guide the bellows structure through the extension and contraction thereof.

The body portion 100 according to the present invention may be provided with a seating portion 120 on which the pressure member 300 is seated. The pressure member 300 may be seated while being coupled to the entrance 210 of the supply part 200 even without a separate seating portion 120. Furthermore, as shown in FIG. 2, it is preferable that the pressure member 300 be provided with a seating portion 120 having a structure such as a setting surface or protrusion and appropriately seated on the seating portion 120.

The first embodiment described above is an embodiment in which the partition 230 is placed inside the supply pipe 200. In the first embodiment, the inside of the supply pipe 200 is blocked by the partition 230, and thus the pressurized air inside the supply pipe 200 should be discharged through the air discharge through hole 220.

Meanwhile, in the present invention, there may be implemented a second embodiment without a partition inside a supply pipe 200. In the case of the second embodiment without a partition, the same configurations provided in the first embodiment with a partition are provided except that the air discharge through hole 220 and the partition 230 are not provided. However, due to the structure without a partition, the flow of pressurized air changes.

Accordingly, descriptions of redundant components will be omitted, and the second embodiment will be described with a focus on differences in configuration.

Figure 11:
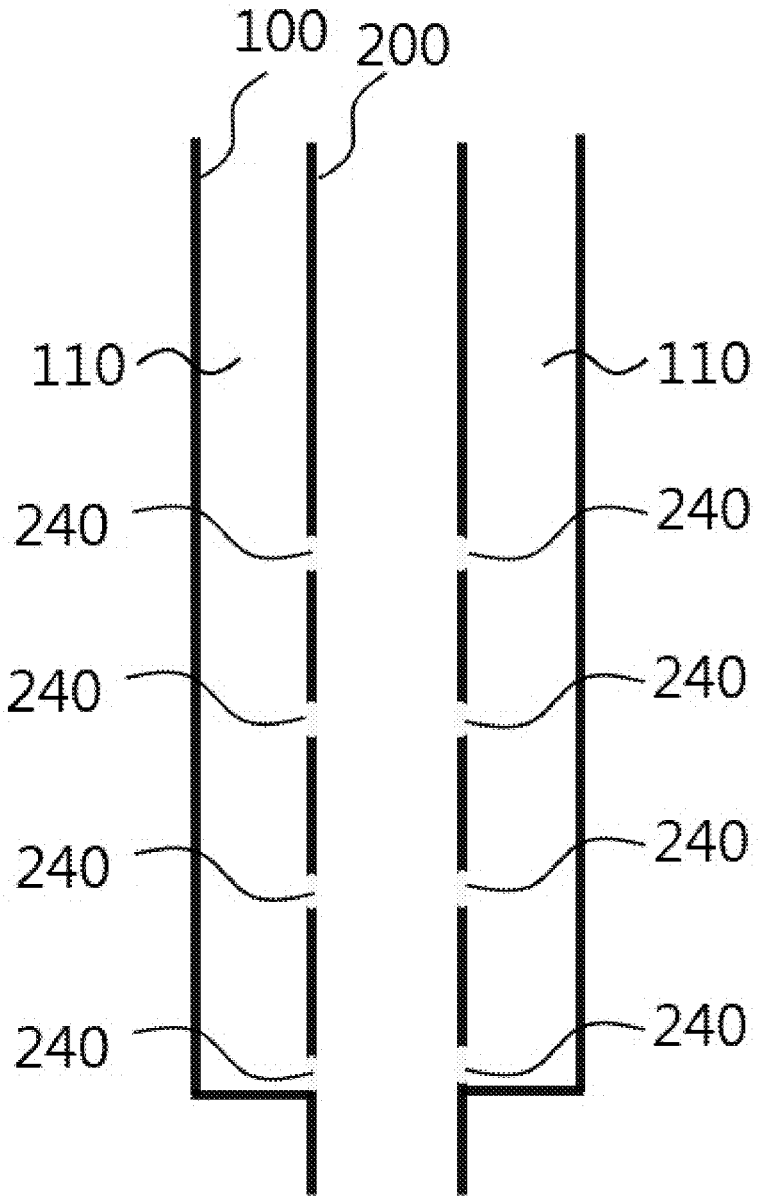
FIGS. 11 and 12 show another embodiment of the present invention, which is an embodiment without an inner partition inside a supply pipe.
Figure 12:
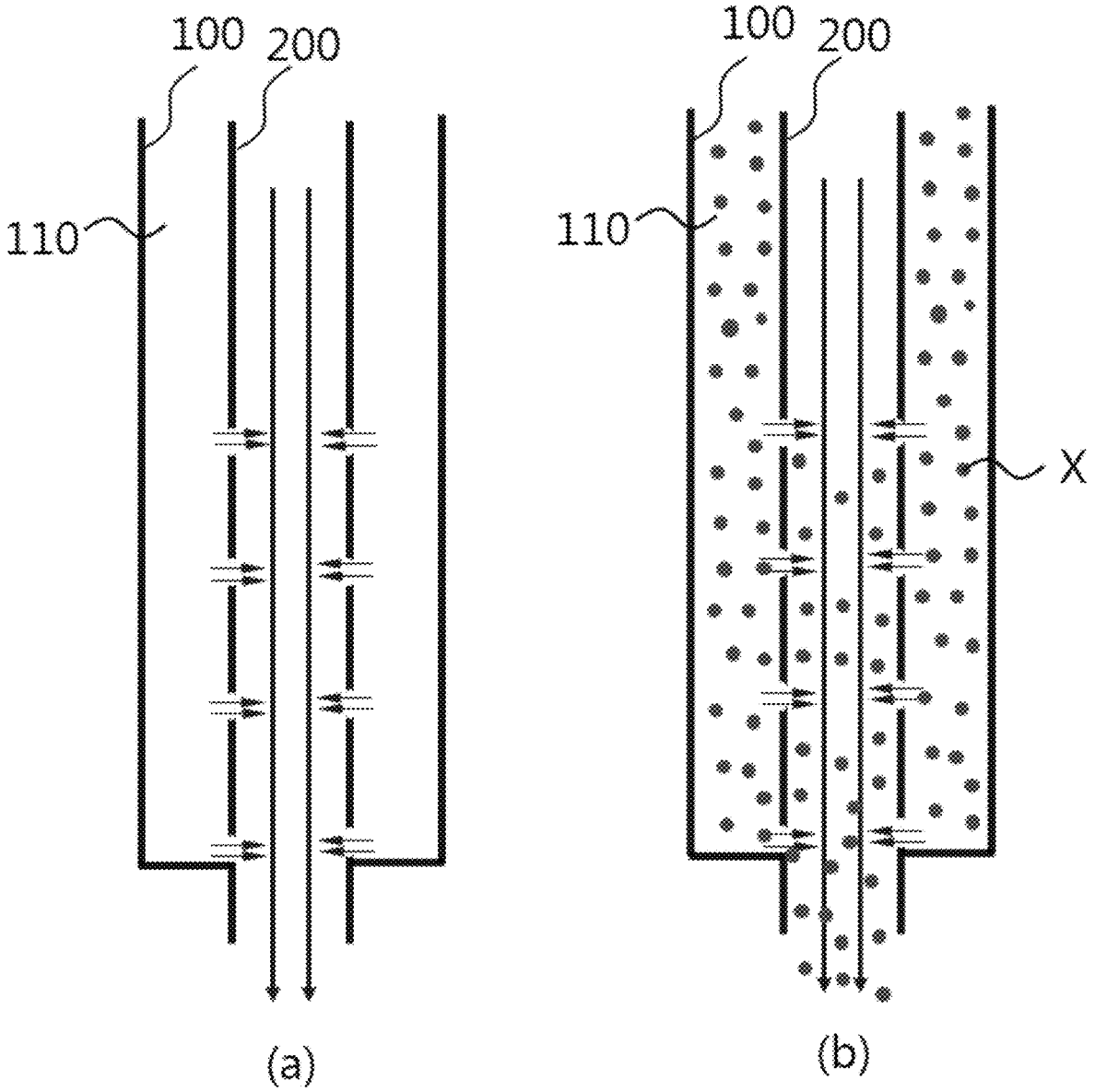

FIGS. 11 and 12 show another embodiment of the present invention, which is an embodiment without an inner partition inside a supply pipe.

As shown in FIG. 11, a plurality of cosmetic material introduction holes 240 are formed in a supply pipe 200 according to the present invention. This embodiment has a structure without a partition therein.

In this embodiment, when pressurized air is injected into the supply pipe 200, it will be moved along the supply pipe 200. Since there is no partition, it will be moved directly up to a spray nozzle 270 (see FIG. 12*a*).

When the pressurized air moves at a high speed, a cosmetic material X in the form of a powder accommodated in the cosmetic material accommodation portion 110 is introduced into a supply pipe 200 through introduction through holes 240 formed in the supply pipe 200 (see FIG. 12*b*).

The introduced cosmetic material X may be sprayed onto a touch member 400 through the nozzle discharge portions 271 of the spray nozzle 270.

The present embodiment has a structure in which the air pressurized by a pressure member 300 is directly moved from the inside of the supply pipe to the spray nozzle 270 in a straight direction, and thus an advantage arises in that feedback on pressurizing (pumping) and the spraying of the cosmetic material is very fast from the perspective of a user.

The embodiments described in the present specification and the accompanying drawings are merely illustrative of some of the technical spirit included in the present invention. Therefore, it is obvious that the embodiments disclosed in the present specification are not intended to limit the technical spirit of the present disclosure but is intended to describe the technical spirit, so that the scope of the technical spirit of the present invention is not limited by these embodiments. Modifications and specific embodiments that can be easily inferred by those skilled in the art without departing from the scope of the technical spirit included in the specification and drawings of the present invention should be interpreted as being included in the scope of the present invention.

The invention claimed is:

1. A cosmetic container having a touch member to which a cosmetic material is transferred by means of pressurized air, the cosmetic container comprising:

a body part having an empty hollow shape, and provided with a cosmetic material accommodation portion therein;

a supply part disposed to pass through the material accommodation portion of the body part, provided in a hollow tube shape, and configured such that an air discharge through hole is formed on one side of a partition disposed inside a hollow tube and a material introduction through hole is formed on a remaining side of the partition;

a pressure member coupled to communicate with an entrance of the supply part at one end of the body part, and configured to inject air into the supply part; and a touch member coupled to communicate with an exit of the supply part at a remaining end of the body part, and configured such that a cosmetic material introduced through the material introduction through hole is transferred thereto, wherein:

a spray nozzle is coupled to the exit of the supply unit; and the spray nozzle is seated on an inner seating portion provided on the touch member.

2. The cosmetic container of claim 1, wherein the body part is provided with a seating portion on which the pressure member is seated.

3. The cosmetic container of claim 1, wherein a discharge guide portion of supply part protruding outward is provided above the air discharge through hole.

4. The cosmetic container of claim 1, wherein a discharge guide portion of body part protruding inward is provided on an inner surface of the material accommodation portion opposite to the air discharge through hole.

5. The cosmetic container of claim 1, wherein the spray nozzle is provided with a plurality of nozzle discharge portions disposed in a longitudinal or diagonal direction of the supply part.

6. The cosmetic container of claim 1, wherein:

a backflow prevention check valve is provided in a discharge hole of the pressure member; and an air hole through which air is introduced is provided on one side of the pressure member.

7. The cosmetic container of claim 1, wherein the pressure member is provided as a bellows structure capable of extending and contracting.

8. The cosmetic container of claim 7, wherein a cover is provided on an outside of the pressure member.

9. The cosmetic container of claim 7, further comprising an elastic spring disposed beside the bellows structure so as to guide the bellows structure through extension and contraction thereof.

10. The cosmetic container of claim 1, wherein a backflow prevention member is disposed inside the supply part.

11. The cosmetic container of claim 10, wherein the backflow prevention member is at least any one of a filter member and a brush member.

12. The cosmetic container of claim 11, wherein the backflow prevention member is disposed in a spiral shape.

13. A cosmetic container having a touch member to which a cosmetic material is transferred by means of pressurized air, the cosmetic container comprising:

a body part having an empty hollow shape, and provided with a cosmetic material accommodation portion therein;

a supply part disposed to pass through the material accommodation portion of the body part, provided in a hollow tube shape, and configured such that a plurality of material introduction through holes are formed in a hollow tube;

a pressure member coupled to communicate with an entrance of the supply part at one end of the body part, and configured to inject air into the supply part; and a touch member coupled to communicate with an exit of the supply part at a remaining end of the body part, and configured such that a cosmetic material introduced through the material introduction through hole is transferred thereto, wherein:

a spray nozzle is coupled to the exit of the supply unit; and the spray nozzle is seated on an inner seating portion provided on the touch member.

14. The cosmetic container of claim 13, wherein the body part is provided with a seating portion on which the pressure member is seated.

15. The cosmetic container of claim 13, wherein a backflow prevention member is disposed inside the supply part.

16. The cosmetic container of claim 13, wherein the pressure member is provided as a bellows structure capable of extending and contracting.

17. The cosmetic container of claim 13, wherein:

a backflow prevention check valve is provided in a discharge hole of the pressure member; and an air hole through which air is introduced is provided on one side of the pressure member.

* * * * *